United States Patent [19]

Winiarski

[11] 4,392,675

[45] Jul. 12, 1983

[54] CHECKBOOK COMPRISING ALTERNATE CHECK BLANKS AND CHECK STUBS

[75] Inventor: Albert C. Winiarski, Nazareth, Pa.

[73] Assignee: Christmas Club, Easton, Pa.

[21] Appl. No.: 226,346

[22] Filed: Jan. 19, 1981

[51] Int. Cl.[3] ..... B41L 1/24

[52] U.S. Cl. ..... 282/23 R; 283/58

[58] Field of Search ..... 282/8 R, 8 A, 8 B, 9 R, 282/23 R, 23 A; 283/58

[56] References Cited

U.S. PATENT DOCUMENTS

| | | | |
|---|---|---|---|
| 3,048,426 | 8/1962 | Rodriguez et al. | 283/58 X |
| 3,278,200 | 10/1966 | Scully | 282/8 R |
| 3,353,845 | 11/1967 | Curran | 282/23 R |
| 4,128,202 | 12/1978 | Buros | 283/58 X |
| 4,225,157 | 9/1980 | Hamacher | 282/23 R |

*Primary Examiner*—Paul A. Bell

*Attorney, Agent, or Firm*—John L. Gray

[57] ABSTRACT

A checkbook comprising alternate check blanks and check stubs with the check stubs being treated with pressure-sensitive material so that when a check is drawn the information placed on the check will also be reproduced on the check stub. The checks are attached at the left-hand edge to a cover and to a backing material which extends beyond the right-hand edge of the check blanks a distance approximately equal to the width of the check blanks and is creased and may be inserted between the check stub and the check blank thereunder so as to prevent writing from appearing on other check stubs thereunder. The backing material also functions as a check register for specific checks if so desired, as well as deposit and other information. The check stub has positioned on it indicia so that the numeric expression of the amount of the check will appear in a column on the stub immediately below the balance forward so that amount then may be deducted from the balance forward to produce a balance. There is also a space for a deposit deduction and balance forward. The check stub has a darkened area so that the signature is not reproduced. The checkbook may also be provided with a series of coupons which may be sent to the bank in order to request copies of checks which are retained by the bank.

1 Claim, 5 Drawing Figures

FIG. 2

11

JOHN H GUINAN
WM PENN HIGHWAY
EASTON, PA 5600-0776
No. 0003

_____ 19____

Pay to the order of _____ $ _____

_____ Dollars

ANY SAVINGS BANK
BROOKLYN BRANCH
NEW YORK, NEW YORK

For _____

⑆5600⑈0776⑆ 0234 1234⑈

FIG. 3

12

JOHN H GUINAN
WM PENN HIGHWAY
EASTON, PA 5600-0776
No. 0003

| | |
|---|---|
| BAL. FOR'D | |
| THIS ITEM | |
| BALANCE | |
| DEPOSIT | |
| DEDUCTION | |
| BAL. FOR'D | |

ANY SAVINGS BANK
BROOKLYN BRANCH
NEW YORK, NEW YORK

For _____

⑆5600⑈0776⑆ 0234 1234⑈

NOT NEGOTIABLE

FIG. 4

13

JOHN H GUINAN
WM PENN HIGHWAY
EASTON, PA 5600-0776

CHECK NO.

PLEASE SEND ME COPIES
OF THE FOLLOWING CHECKS

ANY SAVINGS BANK
BROOKLYN BRANCH
NEW YORK, NEW YORK

⑆5600⑈0776⑆ 0234 1234⑈

_____
SIGNATURE

CHECKBOOK COMPRISING ALTERNATE CHECK BLANKS AND CHECK STUBS

SUMMARY OF THE INVENTION

This invention is directed to a checkbook which is specifically designed and useful in connection with the growing trend of truncation on the part of banks, savings and loans, federal credit unions and other institutions which have checking accounts or their equivalent.

The adoption of electric funds transfer by the banking industry many years ago prevented the industry from being overwhelmed the the handling of the billions of checks which must be accommodated on a daily basis. However, the number of checks in use has continued to mushroom and in order to keep pace with the problem of handling and manipulating a large number of pieces of paper, it is believed that many institutions which offer checking accounts will go to a system of reporting account information to their customers which does not include returning the checks to the customer. The checks will be preserved by the institution and made available to the customer for tax or other purposes upon request. This is known in the industry as "truncation."

One of the common problems in the use of a checkbook, especially when one is hurried, as in a supermarket checkout line, is remembering to write the name of the payee and the amount and date of the check and its number on a check register or check stub. This can result in considerable wasted time when one is attempting to reconcile the bank statement. Various attempts have been made to solve this latter problem as evidenced by U.S. Pat. No. 3,254,906, Moss; U.S. Pat. No. 3,058,758, Govatsos; and U.S. Pat. No. 3,048,426, Rodriguez, et al. However, as far as is known, no one has attempted to solve this problem in combination with solving the problem of truncation, making it convenient for the customer to notify the bank of a request for a copy of a specific check.

It is an object of this invention, therefore, to provide a checkbook in which the stub of the check is automatically filled in with the name of the payee, the amount of the payment in numeric as well as language form, and the date, and where the numeric form of the amount of the payment is conveniently placed in a location so that it may be readily subtracted from the balance forward. Also, whereby additional information such as a deposit or an automatic deduction may be included on the check stub.

In addition, it is an object of this invention to provide a portion of the checkbook protective backing material which may be utilized to limit the transmission of information only to the check stub immediately following the check being written.

A still further object of this invention is to provide a convenient way for the customer to communicate with the banking institution to order copies of checks in the event that the banking institution has retained the checks which it has processed and not returned them to the customer.

This, together with other objects and advantages of the invention, should become apparent in the details of construction and operation as more fully described herein and claimed, reference being had to the accompanying drawings forming a part hereof wherein like numerals refer to like parts throughout.

BRIEF DESCRIPTION OF THE DRAWING

FIG. 2 is a plan view of a check blank from this check book.

FIG. 3 is a plan view of a check stub utilized as part of this invention.

FIG. 4 is a plan view of the instruction sheet to the bank for ordering checks which is part of this checkbook.

DETAILED DESCRIPTION OF THE INVENTION

Figure 1:
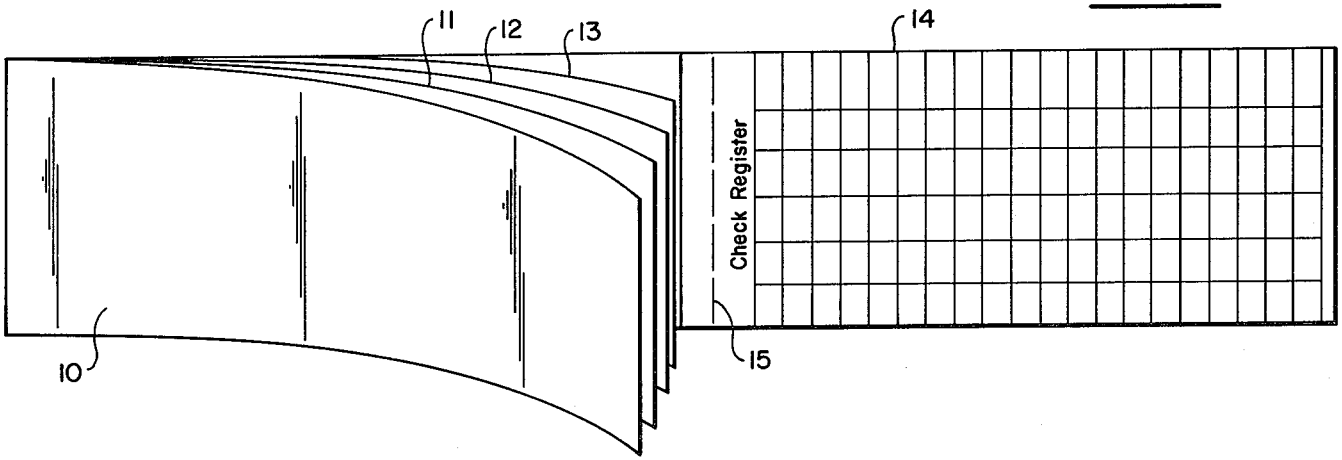
FIG. 1 is a perspective view of the checkbook constituting this invention in an opened position.

Referring now more particularly to FIG. 1, the checkbook is shown opened with the cover 10 which may have an appropriate photograph or other attractive drawing thereon, a check blank 11, a check stub 12, an order blank 13 which may be used to order copies of specific checks from the bank, and the backing material 14 in open position. It should be understood, of course, that there will be several check blanks 11 each followed by a check stub 12 in the checkbook. Usually there are about twenty-five of each, numbered sequentially. The number of check blank 11 and the check stub 12 immediately following will have the same number as will successive pairs, which will be sequentially numbered. The check ordering form 13 will not be numbered. The check blanks 11 are removably attached and the check stubs 12 are fixedly attached to said cover 10 and to said backing material 14 at their left-hand edge.

The backing material 14 may be provided with a check register on the inner side thereof and also on the portion immediately below the check ordering form 13. The backing material 14 is foldable in the area at 15 so that it may be inserted behind a check stub 12 to prevent the next successive check stub 12 from responding to the pressure of a pen when applied to check blank 11.

Referring now more particularly to FIG. 2, the check is in the normal form with the name and address of the payor in the upper left-hand corner, the bank transit number and the check number in the upper right-hand corner, and indicia are provided for insertion of the date, payee, and the amount of the check in numeric and language form. There is provision in the lower right-hand corner for the payor's signature. The name of the bank and indicia to identify the purpose for which the check is drawn and the bank transit number and the payor's checking account number in MICR form is also shown in the lower left corner.

Referring now more particularly to FIG. 3, it will be seen that the check stub 12 contains the name of the payor and his address in the upper left-hand corner, the bank transit number and the number of the corresponding check blank is in the upper right-hand corner. Also indicated in the same relative position as on the check blank 11 is the name of the bank, the purpose for which the check is drawn, and the payor's checking account number and banking number in MICR. In addition, space is reserved so that when the check immediately above has the date, the payor and the amount of the check in language inserted, this will appear in the blank space provided. The area on check stub 13, where the signature of the payor would appear on the check blank 12 immediately above, is darkened so that the signature will not be reproduced on the check stub and, further, the check stub is identified as being not negotiable. In tabular form at the right-hand side of the check stub, spaces are provided for the "balance forward," the amount of the check in numeric form, the "balance," and places for "deposit," "deduction," and "balance forward." The section marked "this item" on the check stub 13 is so positioned that it is immediately below the portion on the check blank 12 where the numeric amount of the check is entered.

Referring now more particularly to FIG. 4, it will be seen that the check ordering form has the name and address of the payor in the upper left-hand corner, the bank's transit number in the upper right-hand corner, payor's checking account number, and the bank MICR information and the name of the bank in the lower left-hand corner. There is also included a place for signature and a request to send copies of certain check numbers and a place where these numbers may be listed.

Figure 5:
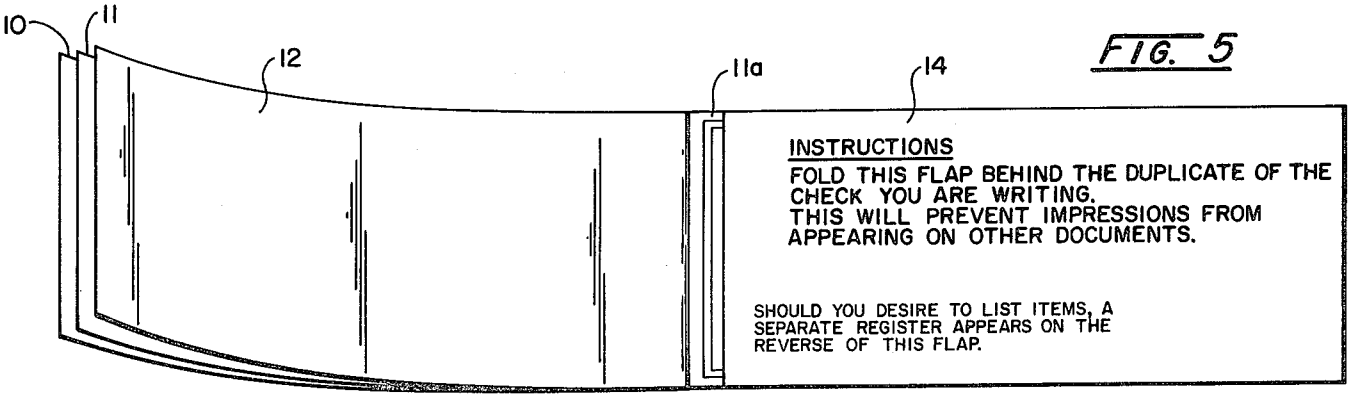
FIG. 5 is a plan view of backing material folded over the checkbook with the cover of the checkbook folded back.

Referring now more particularly to FIG. 5, there is shown the cover 14 folded over a check blank 11*a* with the next upper-check stub 12, corresponding check blank 11, and cover 10 being folded over to the left. The back of the backing material 14 may be provided with suitable instructions as shown. After the backing material is folded in this fashion, then the check stub 12 and corresponding check 11 may be folded down over the backing material and the check made out.

It should be noted that by having the check backing fold in from the end, it is much easier to manipulate than if it were inserted in from the bottom where there would be less flexibility in the backing material so as to make it more difficult to be inserted between the check stub and the next check blank.

It will be apparent from the above that the invention concerns a checkbook which is particularly useful in connection with the truncation of checks by the banking institution and which also provides an automatic register of the check being written without taking the time to make out an additional check register, unless one desires to do so, and which provides for a simple and easy way to prevent the information on the check stub from being transmitted to subsequent check stubs therebelow.

While this invention has been described in its preferred embodiment, it is appreciated that variations therefrom may be made without departing from the proper scope and spirit of the invention.

What is claimed is:

1. A checkbook comprising a cover, alternate check blanks, and check stubs of equal width, said check blanks removably attached and said check stubs fixedly attached at their left-hand end to said cover and to a backing material which extends beyond the right-hand edge of said check blanks and check stubs a distance approximately equal to the width of said check blanks, said check blanks being provided with indicia to accommodate the date, payee, the amount of the check in numeric and language form and the payor's signature, as well as optional information, said check stubs being provided with a pressure sensitive coating thereon, optional information on each said check stub duplicating said optional information on said check blank positioned immediately above said check stub, a darkened area immediately below the indicia for said payor's signature on the check blank immediately above said check stub, whereby said payor's signature is rendered illegible on said check stub, and indicia identifying and providing space for, in descending order, balance forward, the numeric amount of the check immediately above said check stub, the balance, deposit, deduction and balance forward, and a blank area on said check stub immediately below the indicia on said check blank immediately above said check stub accommodating the date, payor, and amount of said check in language form, a plurality of check ordering forms of the same size as said check blanks for ordering individual truncated checks retained by the financial institution on which said checks are drawn, removably attached at their left-hand end to said cover, each said form having indicia to accommodate multiple truncated check orders, said upper side of said backing material being provided with indicia for a check register and said backing material being folded at the right-hand edge of said check blanks, whereby said backing material may be readily inserted between a check stub and the check blank thereunder so as to prevent writing from appearing on other check stubs thereunder while a check blank and check stub above said backing material is being filled in.

* * * * *

UNITED STATES PATENT AND TRADEMARK OFFICE

CERTIFICATE OF CORRECTION

PATENT NO. : 4,392,675

DATED : July 12, 1983

INVENTOR(S) : Albert C. Winiarski

It is certified that error appears in the above-identified patent and that said Letters Patent is hereby corrected as shown below:

Column 1, line 14, "the" first occurrence should read -- by --.

Signed and Sealed this

*Thirteenth* Day of *September 1983*

[SEAL]

*Attest:*

GERALD J. MOSSINGHOFF

*Attesting Officer*

*Commissioner of Patents and Trademarks*